US007062852B2

(12) United States Patent
Shimizuya

(10) Patent No.: US 7,062,852 B2
(45) Date of Patent: Jun. 20, 2006

(54) ROCKER ARM

(75) Inventor: Masayoshi Shimizuya, Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/494,448

(22) PCT Filed: Nov. 21, 2002

(86) PCT No.: PCT/JP02/12159

§ 371 (c)(1),
(2), (4) Date: Apr. 30, 2004

(87) PCT Pub. No.: WO03/044331

PCT Pub. Date: May 30, 2003

(65) Prior Publication Data

US 2004/0261739 A1 Dec. 30, 2004

(30) Foreign Application Priority Data

Nov. 22, 2001 (JP) ..... 2001-357728

(51) Int. Cl.
*B21D 53/84* (2006.01)

(52) U.S. Cl. ..... 29/888.2; 123/90.39; 123/90.44; 74/569

(58) Field of Classification Search ..... 123/90.39, 123/90.41, 90.44, 90.45; 74/559, 569; 29/888.2
See application file for complete search history.

(56) References Cited

U.S. PATENT DOCUMENTS

| | | | | |
|---|---|---|---|---|
| 3,858,427 | A * | 1/1975 | Euteneuer et al. | 72/334 |
| 5,048,475 | A * | 9/1991 | Mills | 123/90.39 |
| 5,720,245 | A * | 2/1998 | Calka | 123/90.41 |
| 5,819,694 | A * | 10/1998 | Trutescu et al. | 123/90.43 |
| 6,425,361 | B1 * | 7/2002 | Motohashi | 123/90.41 |
| 6,615,635 | B1 * | 9/2003 | Ammon | 72/379.2 |

FOREIGN PATENT DOCUMENTS

| | | |
|---|---|---|
| JP | 03-172506 | 7/1991 |
| JP | 07-150909 | 6/1995 |
| JP | 8-4507 A | 1/1996 |
| JP | 2724415 B | 12/1997 |
| JP | 2000-210734 A | 8/2000 |
| JP | 2001-121237 A | 5/2001 |

* cited by examiner

*Primary Examiner*—Thomas Denion
*Assistant Examiner*—Ching Chang
(74) *Attorney, Agent, or Firm*—Crowell & Moring LLP

(57) ABSTRACT

A rocker arm comprises an arm body, a shaft and a roller. The arm body formed substantially in a U-shape in section by effecting drawing on a metal plate, includes a connection wall connecting a pair of side walls, an aperture formed through the connection wall, and through-holes at positions where the pair of side walls are aligned with each other. A peripheral edge of the aperture is so formed as to be finished by inserting a first finishing die into the aperture from between the pair of side walls. The shaft is fitted in the pair of through-holes and extended between the pair of side walls. The roller is rotatably supported on the shaft.

6 Claims, 7 Drawing Sheets

ROCKER ARM

TECHNICAL FIELD

The present invention relates generally to a rocker arm structuring a valve train mechanism of an internal combustion engine, and more particularly to a technology scheming to improve operability and durability, to prevent noises, and so on.

BACKGROUND ART

In recent years, a valve train mechanism of an internal combustion engine has often adopted a roller type rocker arm including a roller rolling on a cam lobe in order to restrain a loss of power and an abrasion on a contact surface due to a friction with a cam shaft. The roller type rocker arm has hitherto adopted a cast or forged arm body, however, for actualizing reductions in inertial mass of a valve gear system and in manufacturing cost, as disclosed in Japanese Patent Application Laid-Open Nos. 3-172506, No. 7-150909 and so on, a variety of arm bodies have been developed as steel plate press formed products.

The arm body as the steel plate press formed product is manufactured through processes of obtaining a blank by punching out a steel plate, etc in a predetermined contour, thereafter having this blank subjected to plastic deformation by a press die assembly, and forming the arm body constructed, substantially in a U-shape in section, of a pair of side walls and a connection wall connecting these side walls. The arm body is formed with an aperture through which the roller is exposed on the side of the cam shaft, wherein this aperture is formed either by a method of punching out after the press forming of the arm body or by a method of punching out simultaneously when punching the blank out. Note that generally a boss, into which a pivot shaft is screwed, is formed by a burring work when molding the arm body, and through-holes, into and through which the roller shaft is press-fitted and inserted, are formed after having formed the arm body.

Incidentally, in the case of adopting the method of punching out the arm body to form the aperture after the press forming, it is inevitable that an internal peripheral edge of the aperture protrudes more or less as a stepped portion from internal surfaces of the side walls in terms of a problem of a way of setting dimensions of a punch for punching the aperture out. As a result, during an operation of the engine, the roller and a side end surface of a bearing (normally a needle bearing) interferes with the stepped portion of the internal peripheral edge of the aperture. This interference hinders smooth rotations of the roller and might be a factor of causing an abnormal abrasion and an emission of noises. On the other hand, when punched out, burrs are produced on the side end surface of the aperture of a roller holding member and, if bent towards an interior of the arm body, might also interfere with the roller and the side end surface of the bearing thereof.

DISCLOSURE OF THE INVENTION

The present invention, which was devised under such circumstances, aims at providing a rocker arm scheming to improve operability and durability and to prevent noises, etc.

For solving the above problems, the present invention provides a rocker arm comprising an arm body, a shaft and a roller, wherein (1) the arm body, (1*a*) formed substantially in the U-shape in section by effecting drawing on a metal plate, includes (1*b*) a pair of side walls, (1*c*) a connection wall connecting the pair of side walls, (1*d*) an aperture formed through the connection wall, and (1*e*) through-holes at positions where the pair of side walls are aligned with each other, (1*f*) a peripheral edge of the aperture is so formed as to be finished by inserting a first finishing die into the aperture from between the pair of side walls, (2) the shaft is fitted in the pair of through-holes and extended between the pair of side walls, and (3) the roller is rotatably supported on the shaft.

According to the present invention, for example, a stepped portion between the internal surfaces of the side walls and the internal peripheral edge of the aperture is vanished by use of the finishing die assembly having a width that is the same as or slightly larger than a distance between the internal surfaces of the two side walls.

Further, in the rocker arm according to the present invention, it is preferable that external end surfaces of the pair of side walls configuring a rocker arm portion surrounding the aperture be so formed as to be finished by pressing a second finishing die against these surfaces.

According to this preferred mode of the present invention, burrs produced on external end surfaces of the side walls configuring the rocker arm portion surrounding the aperture of the roller holding member, are crushed by their being pressed by the second finishing die and thus vanished.

EMBODIMENTS OF THE INVENTION

Figure 1:
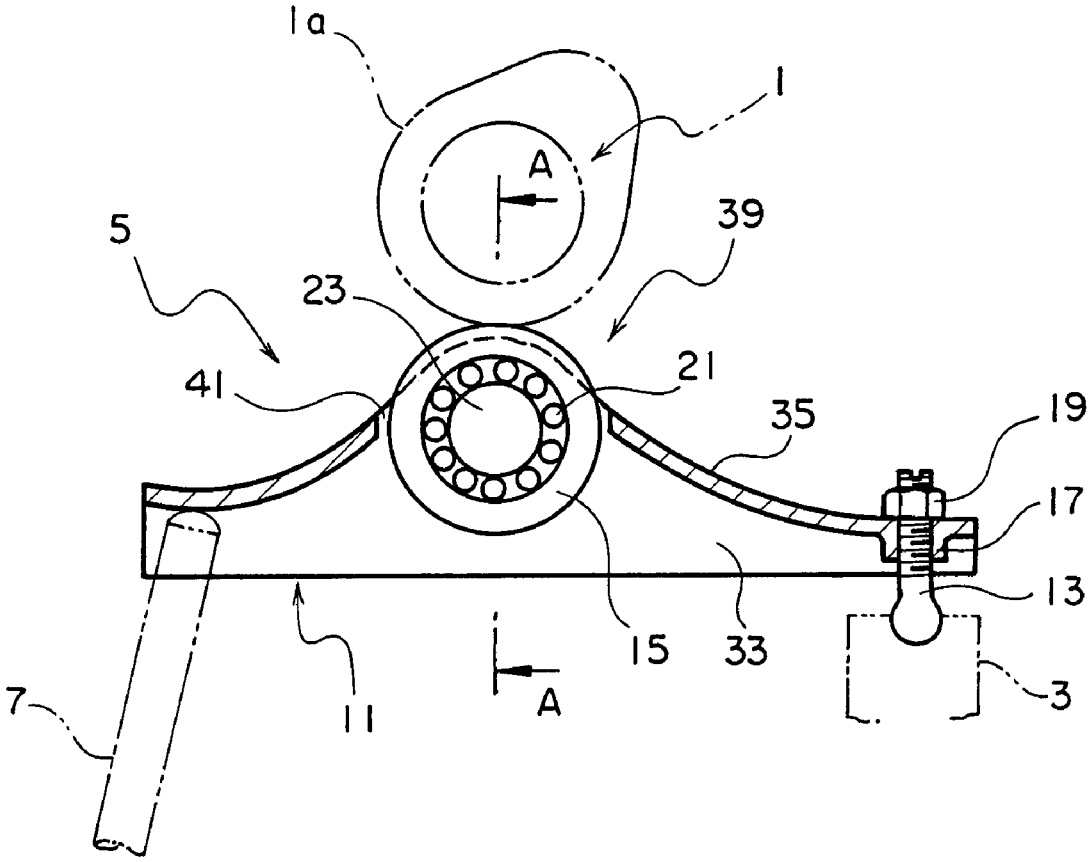
FIG. 1 is a vertical sectional view showing principal portions of a valve train system according to an embodiment of the present invention.
Figure 2:
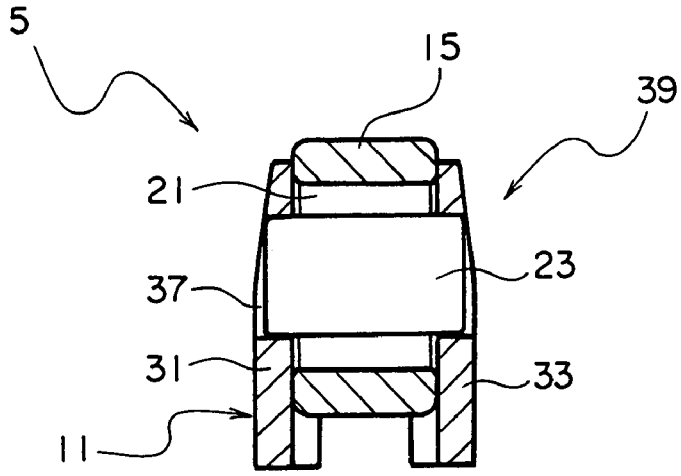
FIG. 2 is a sectional view taken along the line A—A in FIG. 1.

One embodiment in which the present invention is applied to an external fulcrum type of rocker arm used for an OHC (Overhead Camshaft) engine, will hereinafter be described in conjunction with the drawings. FIG. 1 is a vertical sectional view of principal portions of a valve train system according to the embodiment, and FIG. 2 is an enlarged sectional view taken along the line A—A in FIG. 1.

As illustrated in these Figures, the valve train system in the present embodiment is constructed of a cam shaft 1 driven by an unillustrated crank shaft through a timing belt, etc., a rocker arm 5 rocking about a pivot bearing 3 as a fulcrum that is formed in a cylinder head, and a valve 7 abutting on a free end of the rocker arm 5 and thus driven vertically.

The rocker arm 5 includes, as its principal constructive members, an arm body 11 as a press formed product composed of a material such as a cold-rolled steel, etc., a pivot shaft 13 screwed into one end (proximal end) of the arm body 11, and a roller 15 disposed substantially at a central portion of the arm body 11 and rolling on a cam lobe 1*a* of the cam shaft 1. The pivot shaft 13 is, after screwed in a boss 17 formed in the rocker arm 5, locked unslackening by a lock nut 19. Further, the roller 15 is rotatably fitted on a roller pin 23 through a needle bearing 21. The roller pin 23 is press-fitted in the arm body 11

Figure 3:
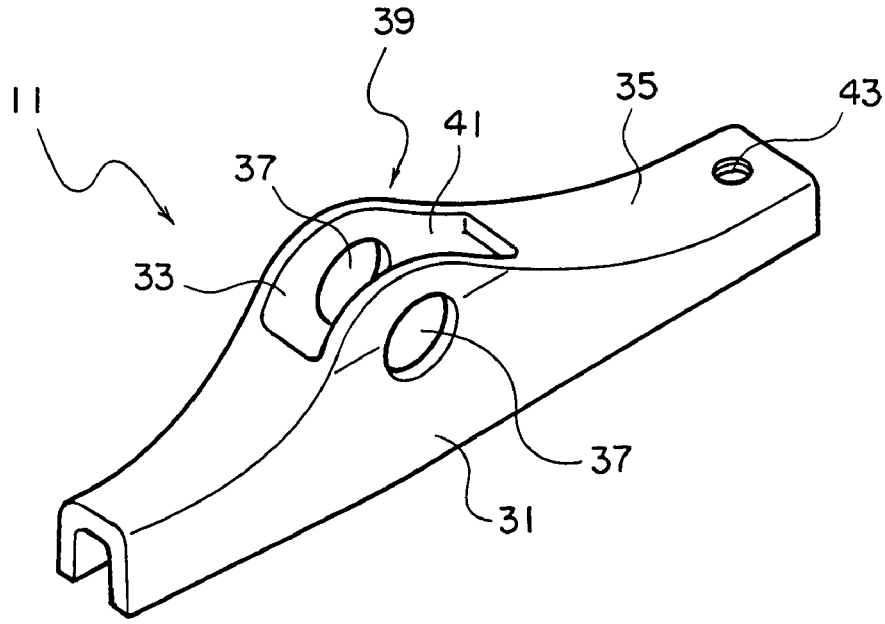
FIG. 3 is a perspective view of an arm body.

FIG. 3 is a perspective view of the arm body 11. As shown in FIG. 3, the arm body 11 is constructed of a pair of side walls 31, 33 and a connection wall 35 connecting these side walls 31, 33, whereby the arm body 11 takes substantially a U-shape in section. The arm body 11 is formed, substantially at its central portion, with a roller holding portion 39 having through-holes 37 in which the roller pin 23 is fitted, and the connection wall 35 of the roller holding portion 39 is formed with a rectangular aperture 41 through which an upper portion of the roller 15 is exposed. Further, the proximal side end of the arm body 11 is formed with a female thread 43 into which the pivot shaft 13 is screwed.

A process of manufacturing the arm body 11 will hereinafter be described.

Figure 4:
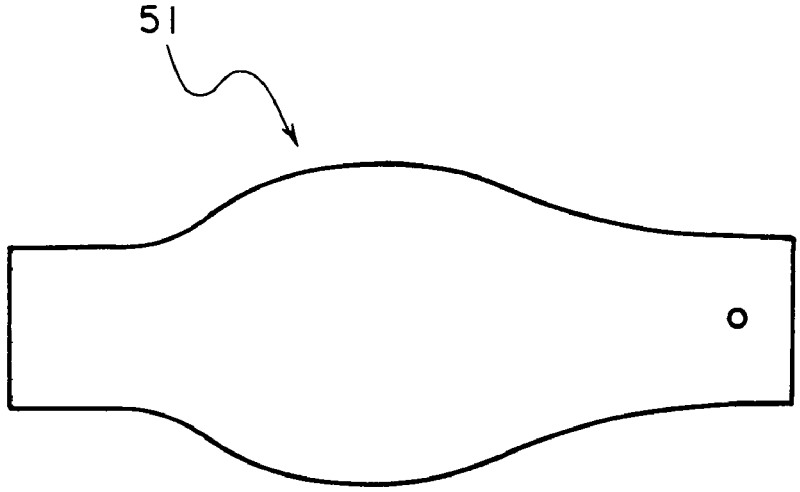
FIG. 4 is a plan view of a blank.
Figure 5:
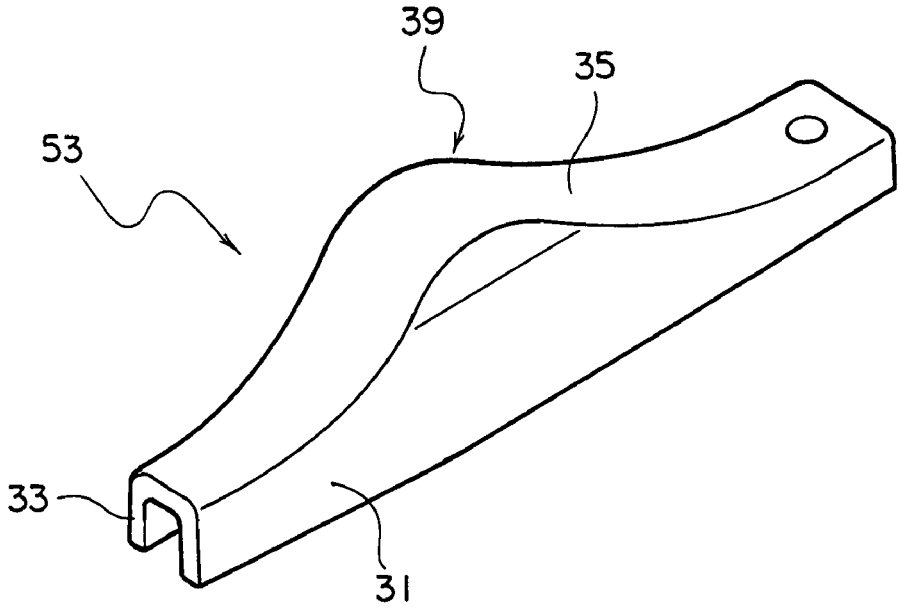
FIG. 5 is a perspective view of a primary work.
Figure 6:
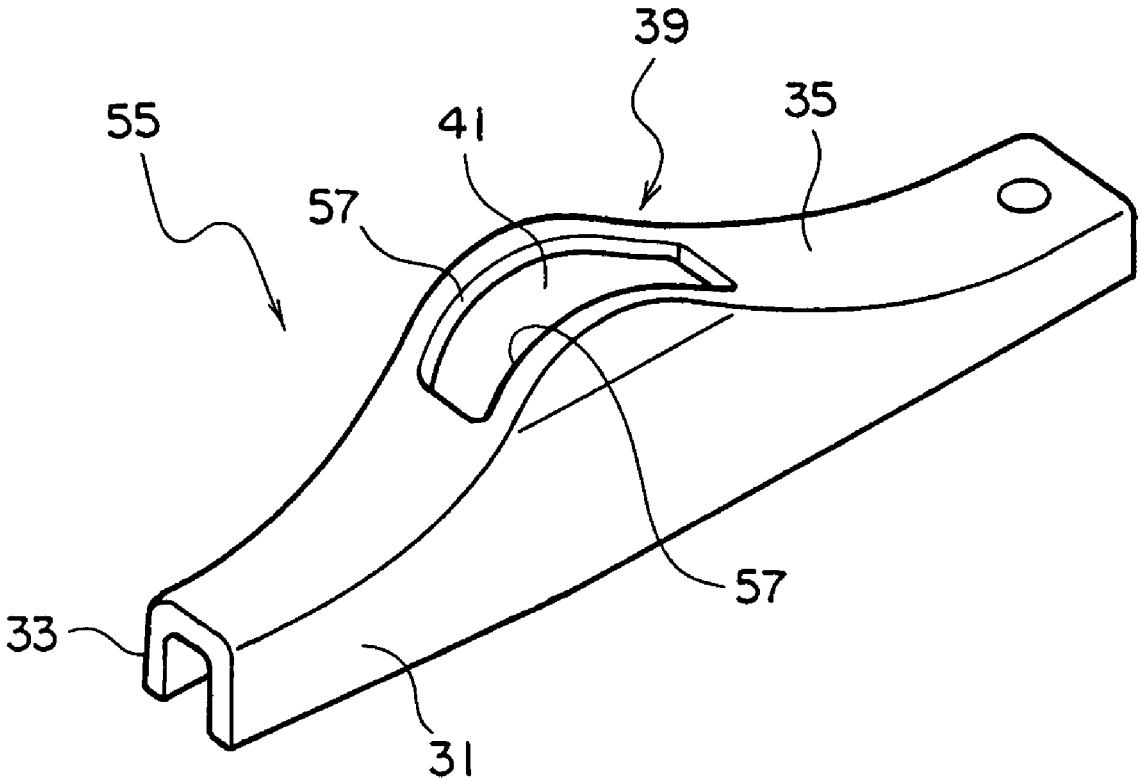
FIG. 6 is a perspective view of a secondary work.

In the case of the present embodiment, a worker at first punches a steel plate out by an unillustrated punch, thereby obtaining a blank 51 shown in FIG. 4. Next, the worker effects drawing (once or a plural number of times) by use of an unillustrated drawing die assembly, thereby obtaining a primary work 53 in which the roller holding member 39 protrudes upwards as FIG. 5 shows its perspective. On this occasion, the boss 17 is formed by burring. Next, the worker configures the aperture 41 by punching out the connection wall 35 of the roller holding portion 39 in the primary work 53 by using the unillustrated punch, thereby obtaining a secondary work 55 as FIG. 6 shows its perspective. In the secondary work 55, inner peripheral edges 57 of the aperture 41 protrude in a flange-like shape along the side walls 31, 33.

Figure 7:
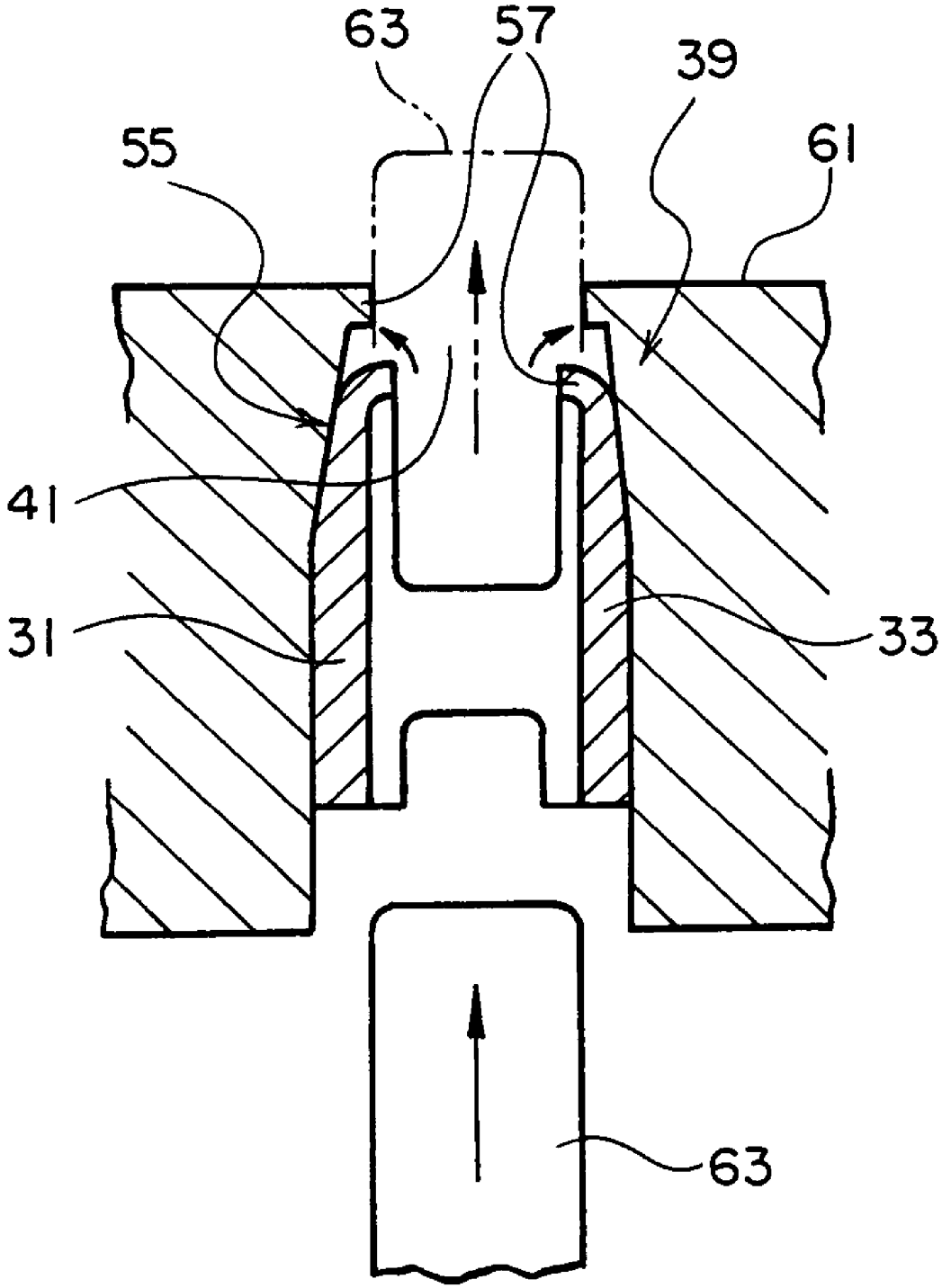
FIG. 7 is a view showing a process of manufacturing a tertiary work.
Figure 8:
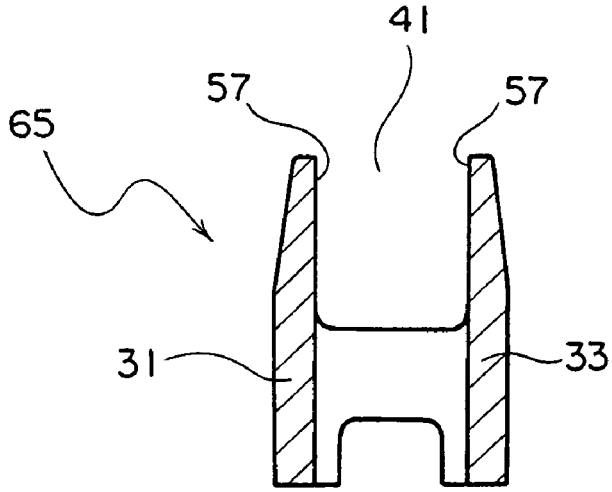
FIG. 8 is a vertical view of the tertiary work.
Figure 9:
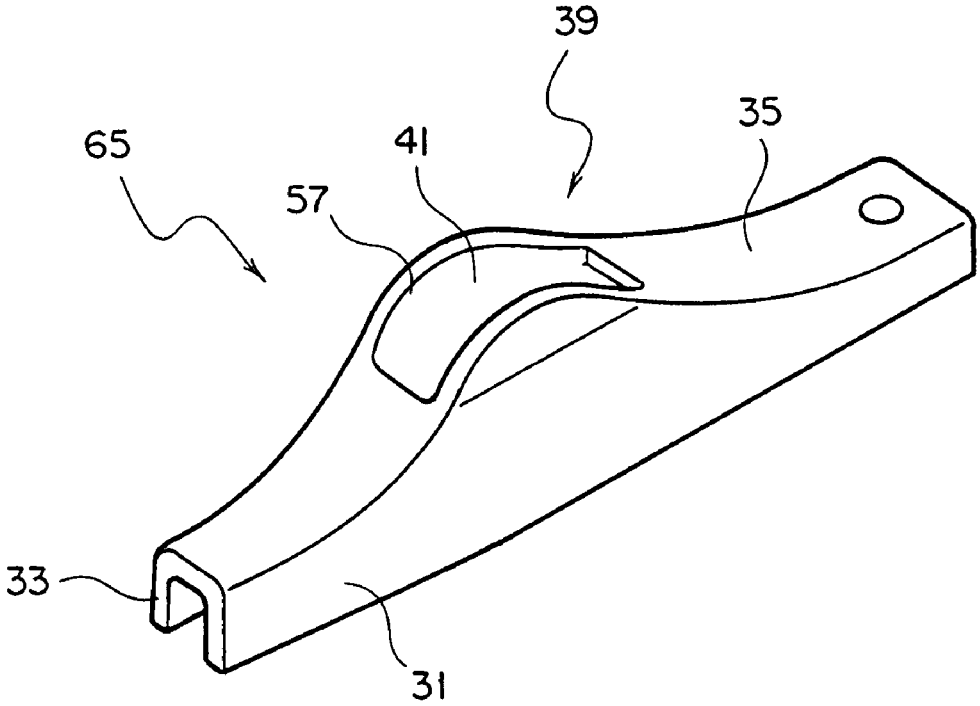
FIG. 9 is a perspective view of the tertiary work.

Subsequently, the worker, as shown in FIG. 7, sets the secondary work 55 in an outer die 61 and has a first finishing die 63 inserted from under. In the case of the present embodiment, the first finishing die 63 is formed slightly wider than an inside interval between the two side walls 31, 33, or formed in the same dimension as the inside interval between the two side walls 31, 33. The inner peripheral edges 57 of the aperture 41 are thereby bent up (plastic working) or sheared, with the result that the inner peripheral edges 57 become flush with internal surfaces of the side walls 31, 33 in the roller holding portion 39, and at the same time, the internal surfaces of the side walls 31, 33 are subjected to ironing to become smoother. A tertiary work 65 shown in FIGS. 8 and 9 is thereby obtained.

Figure 10:
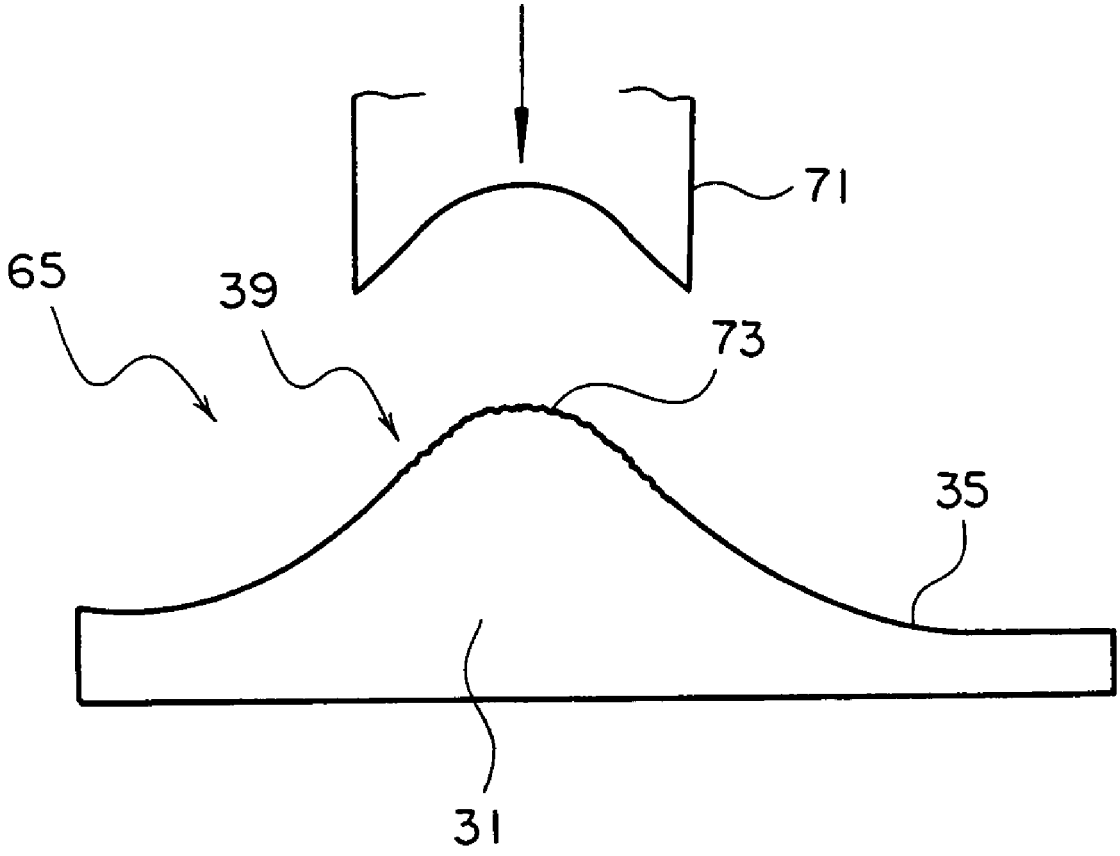
FIG. 10 is a view showing a process of manufacturing a quaternary work.

Next, the worker, as shown in FIG. 10, presses a secondary finishing die 71 against an upper surface of the tertiary work 65, thus vanishing, by crushing, minute burrs 73 generated when punching out for forming the aperture 41. A quaternary work (not shown) is thereby obtained. Note that the tertiary work 65 be, it is desirable, set between the outer die 61 and the first finishing die 63 (or within a different type of jig) in order to prevent deformations of the side walls 31, 33 on this occasion.

Next, the worker performs working on the quaternary work by the unillustrated punch and tap, thereby completing the arm body 11 (FIG. 1) having the through-holes 37 and the female thread 43.

In the present embodiment, the arm body 11 is manufactured in the process described above, thereby making it possible to obtain the smooth flat surfaces with no stepped portion between the side walls 31, 33 and the inner peripheral edges 57 of the aperture 41 in the roller holding portion 39. As a result, the rotations of the roller 15 are extremely smoothed by reducing a frictional resistance, and at the same time, even when used over a long period of time, there are neither abrasions of the roller 15 and of the end surface of the needle bearing 21 nor the emission of noises caused by the rotations of the roller 15.

The explanation of the specific embodiment comes to an end so far, however, the mode of the present invention is not limited to this embodiment. For example, in the embodiment discussed above, the present invention is applied to the external fulcrum type of rocker arm and can be also applied to an internal fulcrum type of rocker arm. Further, in a valve train system where a rush adjuster is adopted for the pivot, the adjusting type of pivot shaft is not required, and hence the pivot protrusion can be integrally formed on the proximal end of the arm body. For others, the specific construction of the valve train mechanism inclusive of the specific configuration of the arm body and the manufacturing process thereof, can be properly changed within the range that does not deviate from the gist of the present invention.

As discussed above, according to the present invention, the rocker arm comprises the arm body, the shaft and the roller. The arm body is formed substantially in the U-shape in section by effecting the drawing on the metal plate, and includes the connection wall connecting the pair of side walls, the aperture formed through the connection wall, and the through-holes at positions where the pair of side walls are aligned with each other. The peripheral edge of the aperture is so formed as to be finished by inserting the first finishing die into the aperture from between the pair of side walls. The shaft is fitted in the pair of through-holes and extended between the pair of side walls. The roller is rotatably supported on the shaft. Hence the stepped portion between the internal surfaces of the side walls and the inner peripheral edge of the aperture are vanished, with the result that the rotations of the roller are smoothed and, at the same time, even when used over a long period of time, there are neither abrasions of the roller and of the end surface of the needle bearing nor the emission of noises caused by the rotations of the roller.

Moreover, according to the preferred mode of the present invention, in the rocker arm of the present invention, the external end surfaces of the pair of side walls configuring the rocker arm portion surrounding the aperture are so formed as to be finished by pressing the second finishing die against these surfaces. Therefore, the burrs produced on the external end surfaces of the side walls configuring the rocker arm portion surrounding the aperture of the roller holding member, are crushed by their being pressed by the second finishing die and thus vanished, thereby causing no interference with the roller and with the side end surfaces of the bearing, which might be derived from flexures of the burrs inwards of the arm body.

What is claimed is:

1. Process for manufacturing a rocker arm body which includes a pair of side walls, a connection wall connecting said pair of side walls, comprising the steps of:

press-forming a rocker arm body blank of a U-shape in section which includes a pair of side walls and a connection wall connecting said pair of side walls by drawing a metal plate blank;

forming through-holes in positions where said pair of side walls are aligned with each other;

punching said connection wall of said rocker arm body blank to form an aperture; and inserting, while supporting said rocker arm body blank in an outer die, a first finishing die into said aperture from between said pair of side walls so that an inner peripheral edge of said aperture may be bent up by being plastically deformed or sheared, thereby finishing a peripheral edge of said aperture.

2. Process for manufacturing a rocker arm body according to claim 1, further comprising a step of:

pressing and finishing a second finishing die against external end surfaces of said pair of side walls configuring a rocker arm portion surrounding said aperture to form and finish said external end surfaces.

3. Process for manufacturing a rocker arm body according to claim 1, wherein the peripheral edge of the aperture is flush with internal surfaces of the pair of side walls.

4. Process for manufacturing a rocker arm which includes an arm body which is formed of metal plate and includes a pair of side walls, a connection wall connecting said pair of side walls, an aperture formed through said connection wall, and through-holes in positions where said pair of side walls are aligned with each other, a shaft fitted in said pair of through-holes and extended between said pair of side walls, and a roller rotatably supported on said shaft, said roller being exposed partially through said aperture to be in contact with a cam robe, said process comprising the steps of:

press-forming a rocker arm body blank of a U-shape in section which includes a pair of side walls and a connection wall connecting said pair of side walls by drawing a metal plate blank;

forming through-holes through said side walls in positions where said pair of side walls are aligned with each other;

punching said connection wall of said rocker arm body blank to form the aperture; and inserting, while supporting said rocker arm body blank in an outer die, a first finishing die into said aperture from between said pair of side walls so that an inner peripheral edge of said aperture may be bent up by being plastically deformed or sheared, thereby finishing a peripheral edge of said aperture.

5. Process for manufacturing a rocker arm according to claim 4, further comprising a step of:

pressing a second finishing die against external end surfaces of said pair of side walls configuring a rocker arm portion surrounding said aperture to form and finish said external end surfaces.

6. Process for manufacturing a rocker arm body according to claim 4, wherein the peripheral edge of the aperture is flush with internal surfaces of the pair of side walls.

* * * * *